US009500447B1

(12) United States Patent
Cannon, Jr.

(10) Patent No.: US 9,500,447 B1
(45) Date of Patent: Nov. 22, 2016

(54) MULTI-FREQUENCY PROJECTED ENERGY GUN

(71) Applicant: Thomas Calvin Cannon, Jr., La Plata, MD (US)

(72) Inventor: Thomas Calvin Cannon, Jr., La Plata, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/999,320

(22) Filed: Feb. 11, 2014

(51) Int. Cl.
*F41H 13/00* (2006.01)

(52) U.S. Cl.
CPC ..... *F41H 13/0043* (2013.01); *F41H 13/0075* (2013.01); *F41H 13/0081* (2013.01)

(58) Field of Classification Search
CPC ..... F41H 13/0043–13/0087
See application file for complete search history.

(56) References Cited

U.S. PATENT DOCUMENTS 3,028,597 A 4/1962 Cicchetti et al.
4,359,944 A * 11/1982 Stiennon ..... F41H 11/02 102/401
5,909,129 A 6/1999 Murphy et al.
7,040,780 B2 * 5/2006 Diehl ..... F41H 13/0081 362/234
7,164,234 B2 * 1/2007 Achenbach ..... H03F 3/54 315/39.3
7,342,534 B1 3/2008 Seddon et al.
7,994,962 B1 * 8/2011 Ben-Shmuel ..... H01Q 19/18 342/13
8,049,173 B1 * 11/2011 Brown ..... F41G 1/35 250/341.7
2011/0235465 A1 * 9/2011 Bostick ..... F41H 13/0081 367/99

* cited by examiner

*Primary Examiner* — Matthew M Barker
(74) *Attorney, Agent, or Firm* — Fredric Zimmerman

(57) ABSTRACT

A multi-frequency projected energy gun system and method delivers energy to a target. The method includes generating simultaneously at least two signals from a source, amplifying the signals, combining the signals, and transmitting the signals into a medium or a vacuous space. The source includes one or more of a plurality of waveform generators configured to simultaneously generate at least two signals simultaneously. The signals are amplified by a power amplifier configured to amplify the power of the at least two signals. The signals are transmitted by one or more of a plurality of antennas configured to transmit the at least two signals simultaneously into a medium or a vacuous space.

12 Claims, 5 Drawing Sheets

MULTI-FREQUENCY PROJECTED ENERGY GUN

STATEMENT OF GOVERNMENT INTEREST

The invention described herein may be manufactured and used by or for the Government of the United States of America for Governmental purposes without the payment of any royalties thereon or therefore.

BACKGROUND OF INVENTION

1) Field of the Invention

The present invention is directed to systems and methods of delivering amplified power to a target.

2) Description of Prior Art

High power radio frequency (HPRF) systems propagate radar signals at high power from a source to deliver energy to a target. Conventional HPRF systems often use a single frequency radar gun to transmit signals through the atmosphere before delivering energy to a target. These HPRF systems are limited in range to less than one kilometer due to geometric dispersion and air ionization. Geometric dispersion reduces HPRF signal intensity in proportion to the square of the distance from the source. In addition, air ionizes at high signal intensities and is known as blooming. Blooming occurs at approximately one megawatt per square centimeter, thereby inhibiting propagation of the radar signal. Therefore, use of a single frequency radar signal is ineffective in overcoming geometric dispersion and air ionization associated with propagating high power to a target. Hence the energy delivered to a target by a single frequency radar gun is constrained by energy loss at long ranges and by energy input at short ranges.

SUMMARY OF THE INVENTION

Exemplary embodiments of systems and methods in accordance with the present invention overcome the limitations of previous radar guns by generating a resultant or combined signal containing at least two and, in an exemplary embodiment, a plurality of signals having different frequencies selectively aligned so that the resultant signal increases in intensity as it propagates a distance from a source, e.g., an energy gun, towards the target. This alignment results in a multi-frequency projected energy gun. In one embodiment, the present invention is directed to a method for delivering multi-frequency projected energy by generating at least two signals from one or more of a plurality of waveform generators, amplifying the signals, combining the signals, and transmitting the signals into a medium. The signals are transmitted such that they destructively interfere near the source and constructively interfere as they propagate closer to the target. Suitable signals include, but are not limited to, electromagnetic waves, acoustic waves, radar waves and sonar waves. Suitable mediums for the propagation of the signals include, but are not limited to, gas, such as air, the atmosphere or space, liquids, such as water, and solid media such as rocks, soil and manmade structures.

The signals include a plurality of distinct frequencies. As the plurality of signals have a plurality of distinct or varying frequencies, phase alignment among the plurality of signals is used to enhance or suppress selectively the intensity or energy in the combined plurality of signals. While the phase alignment can be consistent along entire propagation path of the plurality of signals, preferably, the phase alignment is varied along the propagation path, varying the resultant energy along the propagation path. In one embodiment, the resultant or combined signal contains a plurality of signals that are initially out of phase with each another at their source and subsequently in phase with each at the target.

A signal generating source is used to produce the plurality of signals with the desired initial frequency alignment. In one embodiment, the signal generating source includes at least one and preferably a plurality of waveform generators configured to simultaneously generate at least two signals and preferably a plurality of signals. The plurality of signals are amplified using a power amplifier configured to amplify the power of the plurality of signals. The plurality of signals are transmitted using one or more antennas at the signal generating source that are in communication with the waveform generators and amplifiers. In one embodiment, the antennas are configured to transmit the plurality of signals into a desired medium simultaneously.

BRIEF DESCRIPTION OF THE DRAWINGS

It will be understood that many additional changes in details, materials, steps, and arrangements of parts which have been described herein and illustrated in order to explain the nature of the invention, may be made by those skilled in the art within the principle and scope of the invention as expressed in the appended claims.

DETAILED DESCRIPTION OF THE INVENTION

In the description which follows, any reference to either direction or orientation is intended primarily and solely for purposes of illustration and is not intended in any way as a limitation on the scope of the present invention. Also the particular embodiments described herein, although exemplary, are not to be considered as limiting of the present invention.

Exemplary embodiments in accordance with the present invention utilize chromatic dispersion to compensate for geometric dispersion of high power radio frequency (HPRF) signals, generally at ranges exceeding 15 km. These systems deliver increased energy to a target while masking the location of the source, i.e., the high-energy transmitters. In one embodiment, a Projected Energy Gun (PEG) operates by emitting closely spaced frequencies that destructively interfere at their source and constructively interfere at the target range. By using multiple frequencies that destructively interfere at their source, but constructively interfere further down range, the amount of power pumped into the atmosphere can be increased, thereby increasing the energy delivered on target at long range.

In non-dispersive media, e.g., outer space, signals that interfere at their source will continue to interfere all along their paths. However, in dispersive media, e.g., air, different frequencies propagate at different speeds, causing two different frequencies to periodically come into and out of phase as they propagate. Systems and methods in accordance with the present invention select a combination of frequencies such that the envelope of their magnitudes is a maximum at the desired target intercept range. In one embodiment, the energy delivered on target at 15 km by a two-frequency PEG is up to about 42,925 times greater than that of a one-frequency gun—provided the PEG's output energy is increased by this same factor of 42,925. In another exemplary embodiment, the output power of a HPFR gun is increased by a factor of 225 to extend its range from 1 km to 15 km since range increases in proportion to the square root of the power. These systems and methods utilize a PEG that supports a factor of 225 increase in transmitted power.

A PEG alters the spatial profile of pulsed electromagnetic waves and pulsed acoustic waves having wavelengths greater than about 0.1 cm (300 GHz). The total energy transmitted by a PEG system remains unchanged. Only the wave's intensity as a function of distance changes. Therefore, a PEG does not eliminate geometric dispersion, it compensates for geometric dispersion. A PEG uses chromatic dispersion to cause the envelope of multi-frequency waves to grow with range, thereby compensating for geometric dispersion.

Figure 1:
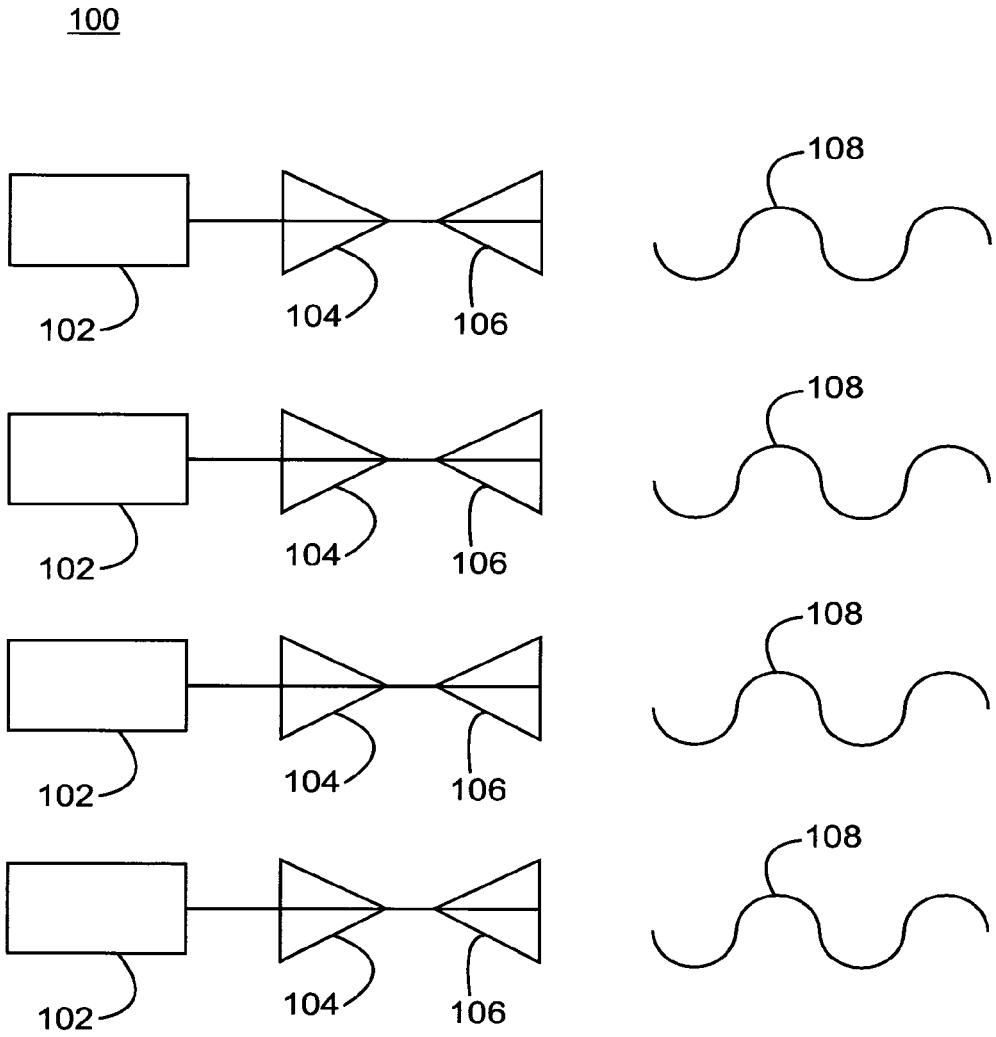
FIG. 1 is a schematic representation of an embodiment of a projected energy gun in accordance with the present invention.

Referring initially to FIG. 1, an exemplary embodiment of a multi-frequency projected energy gun (PEG) 100 configured to deliver energy to a target in accordance with the present invention is illustrated. The PEG is configured to emitting two or more signals 108 simultaneously having nearly identical but different frequencies that destructively interfere at the source and constructively interfere near the target. The PEG includes a waveform generator (WG) 102 having circuitry that creates a low-power signal. The PEG also includes a power amplifier (PA) 104 in communication with the WG to receive the waveform generated by the WG and an antenna 106 in communication with the PA to transmit the signals 108, i.e., the energy into the desired medium.

Unlike a conventional HPRF system, the PEG may use multiple WGs and PAs. In one embodiment, the PEG emits a series of signal or wave packets known as pulses. Each wave packet contains the same number of wavelengths of a base frequency. As the objective is to maximize the signal amplitude at the target versus the signal amplitude at the source, the transition from destructive interference to constructive interference is effected using differences in the refractive index of the different wavelengths. This mechanism is known as chromatic dispersion. Longer wavelengths travel faster than slower ones as atmospheric air is a dispersive media. Closely spaced signals take many wavelengths to transition from destructive interference to constructive interference. The PEG includes parameters that are tuned in order to optimize constructive interference at the target range.

The length of each signal or wave packet is the pulse width, PW, and the duration between pulses is the rest time, RT. The pulse repetition rate, PRT, equals PW+RT. A two-frequency PEG combines a base signal frequency, $f_1$, with a second signal frequency, $f_2$, nearly equal to $f_1$, but 180 degrees out of phase with $f_1$. The wavelengths corresponding to $f_1$ and $f_2$ are designated as $\lambda_1$ and $\lambda_2$, respectively, with $\lambda_1$ being the slowest traveling signal.

In one embodiment, the PEG utilizes at least two distinct signals having distinct frequencies. Alternatively, the PEG uses three or more signals of differing frequencies to achieve a more optimal operation. Once emitted, the PEG wave packets change along their propagation path due to chromatic dispersion. Over extended distances the input signals periodically go into and out of phase with each another. The equations illustrating this phase alignment along propagation path for a three-frequency system are:

$$Y_1=A_1 \cos [(2\pi/\lambda_1)(r-ct/n_1)+\phi_1]$$

$$Y_2=A_2 \cos [(2\pi/\lambda_2)(r-ct/n_2)+\phi_2]$$

$$Y_3=A_3 \cos [(2\pi/\lambda_3)(r-ct/n_3)+\phi_3]$$

$$Y_T=Y_tot=Y_1+Y_2+Y_3, \text{ where}$$

r is the distance (range) from the gun (PEG), c is the speed of light in a vacuum, and t is time. The index of refraction of wavelengths $\lambda_1$, $\lambda_2$ and $\lambda_3$ are $n_1$, $n_2$, and $n_3$, respectively. The refractive indices are uniquely determined by the associated wavelengths as governed by the physical properties of the atmosphere.

In order to illustrate a methodology for selecting optimal wavelengths, the wavelength equations are developed for a two-frequency system are derived. While the resulting equations represent a two-wavelength system, the basic approach may be applied to systems comprising three or more wavelengths. In general, the phase of the base frequency, $\phi_1$, of a two-frequency system is set equal to zero such that $\phi_2=\pi$. For wavelengths between about 0.00525 and about 0.013 meters, the index of refraction of air, n, monotonically decrease with wavelength. This wavelength range is one region of interest. It is easier to focus the energy of radar beams in specific directions if the beam operates at high-frequency, and the speeds of high-frequency signals increase at higher rates with wavelengths in this region. The wavelength region between about 0.0045 and about 0.00525 meters is also viable and corresponds to even higher frequencies, requiring even greater precision in the two wavelengths.

The two signals of differing frequencies are spaced sufficiently close to delay reinforcing one another until the combined signal is a desired distance from the source, i.e., the PEG. Therefore, the differences between the arguments of equations $Y_2$ and $Y_1$, $\Delta$Arg, at the mouth of the PEG (r=0), do not equal $2\pi$ until some prescribed time, t, or:

$$\Delta Arg=Arg2-Arg1, \text{ or}$$

$$\Delta Arg=(2\pi/\lambda_2)(r-ct/n_2)+\phi_2-(2\pi/\lambda_1)(r-ct/n_1)-\phi_1=2\pi.$$

Substituting r=0, $\phi_1=0$, and $=\pi$ into this above equation and solving for t yields:

$$t=(\tfrac{1}{2}c)(\lambda_1\lambda_2 n_1 n_2)/(n_2\lambda_2-n_1\lambda_1)$$

Selecting t equal to the time it takes for the slowest wave, $\Delta_1$, to reach the target at range R, gives:

$$t=Rn_1/c$$

Eliminating t from the above two equations specifies the relationship between R and the other parameters of the system:

$$R=(n_2/n_1)\lambda_1\lambda_2/2[(n_2/n_1)\lambda_2-\lambda_1]$$

A single equation is desired to define the second wavelength, $\lambda_2$, given the first wavelength, $\lambda_1$. This equation is obtained by specifying the ratio $n_2/n_1$. Since $n_2/n_1$ changes slowly with wavelength, this yields:

$$n_2=n_1+(\Delta n_2/\Delta\lambda)(\lambda_2-\lambda_1),$$

where $\Delta n_2/\Delta\lambda$ is defined as the slope, s. Hence, $$n_2/n_1=1+(s/n_1)(\lambda_2-\lambda_1)$$

Substituting the above relationship into the equation for R yields:

$$(\lambda_2)^2+(n_1/s-\lambda_1)\lambda_2-(n_1/s)/(1/\lambda_1-1/R)$$

Solving for $\lambda_2$ results in the desired expression for $\lambda_2$ in terms of $n_1$, $\lambda_1$, s, and R:

$$\lambda_2=(\lambda_1-n_1/s)/2+[n_1/s-\lambda_1)^2/4+(n_1/s)/(1/\lambda_1-1/R)]^{1/2}$$

Similar relationships can be derived for the three signal case. It is noted that the base wavelength, $\lambda_1$, is chosen at a point where the slope of the index of refraction curve (index versus wavelength), s, is highly negative, so that the two or three refractive indexes are appreciably different.

An exemplary analysis for a two-frequency case illustrates how the PEG reduces HPRF intensities between the PEG and the target. A base wavelength, $\lambda_1$, of 6.275 millimeters, corresponding to a frequency of 47.7953398 GHz is selected. Selecting a value for $\lambda_1$ automatically determines $n_1$, based on the plot of refractivity versus wavelength where refractivity equals the index of refraction −1. The complete set of system parameters is shown below in Table 1.

TABLE 1

Parameters for a Two-Frequency PEG with $\lambda_1$ = 6.275 millimeters

| Parameter | Symbol | Value | Units |
|---|---|---|---|
| Target Range | R | 15,000 | m (meters) |
| Wavelength 1 | $\lambda_1$ | 6.27500000 | Millimeters |
| Wavelength 2 | $\lambda_2$ | 6.27500133 | Millimeters |
| Refractive Index 1 | $n_1$ | 1.0002808880000 | |
| Refractive Index 2 | $n_2$ | 1.0002808879987 | |
| Frequency 1 | $f_1$ | 47.7953398 | GHz |
| Frequency 2 | $f_2$ | 47.7953298 | GHz |
| Amplitude of Wave 1 | $A_1$ | 1.0 | |
| Amplitude of Wave 2 | $A_2$ | 1.0 | |
| Phase Angle of Wave 1 | $\phi_1$ | 0.0 | Radians |
| Phase Angle of Wave 2 | $\phi_2$ | $\pi$ | Radians |
| Pulse Width | PW | 0.67 | nanoseconds |

Figure 2:
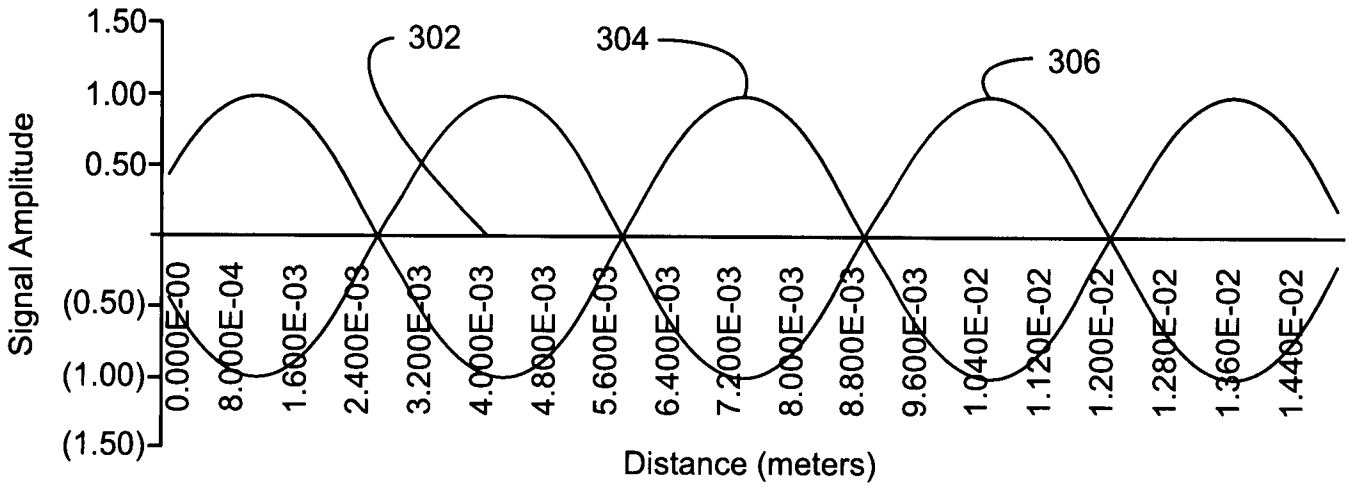
FIG. 2 is a graph illustrating combined wave of a two-frequency PEG during the first few cycles.

Referring now to FIG. 2, a graph 300 illustrating the combined waves of the two-frequencies near the mouth of the PEG (r=0) is illustrated, after slightly more than two wavelengths of the base frequency, $\lambda_1$. The base frequency wave 304 initially leads the second frequency wave 306 by $\pi$ radians, and this lead remains through about 0.014 meters. During this initial period the two signals nearly cancel one another as illustrated by the resultant wave 302. Therefore, amplification of the two signals is used before the waves are combined. Otherwise the combined signal would be lost and overcome by the ambient signal-to-noise ratio.

Figure 3:
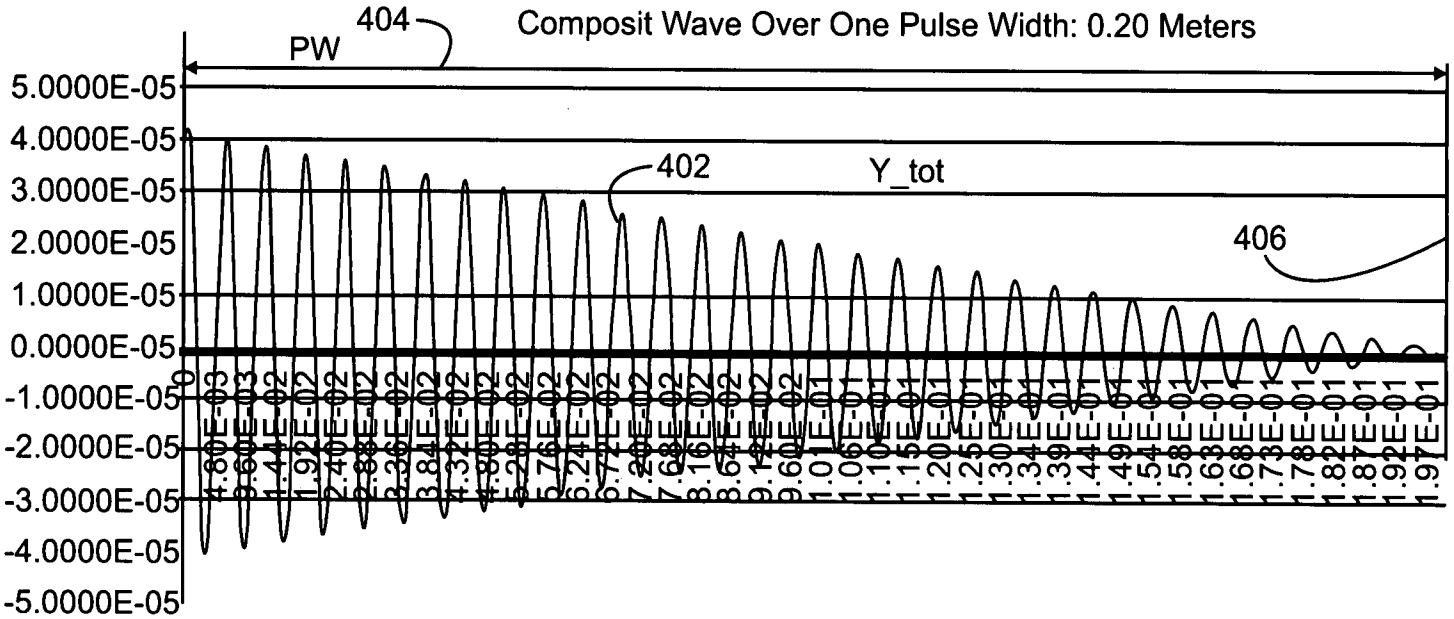
FIG. 3 is a graph illustrating combined waves over a full pulse width.

Referring now to FIG. 3, the combined signal 402 of FIG. 2 is illustrated over a full pulse width (PW) 404 of about 0.67 nanoseconds (0.2 meters). The amplitude of the combined wave at the end 406 of the first PW, Y_tot_p, is only about 0.0000417 as the two signals effectively cancel one another. The PEG is switched off, and a new pulse stream, i.e., wave signal, is transmitted after a few microseconds delay. After the PEG is switched off, the combined amplitude of the first signal and of each succeeding signal continues to propagate until reaching its maximum value some time after the leading edge passes the target.

Figure 4:
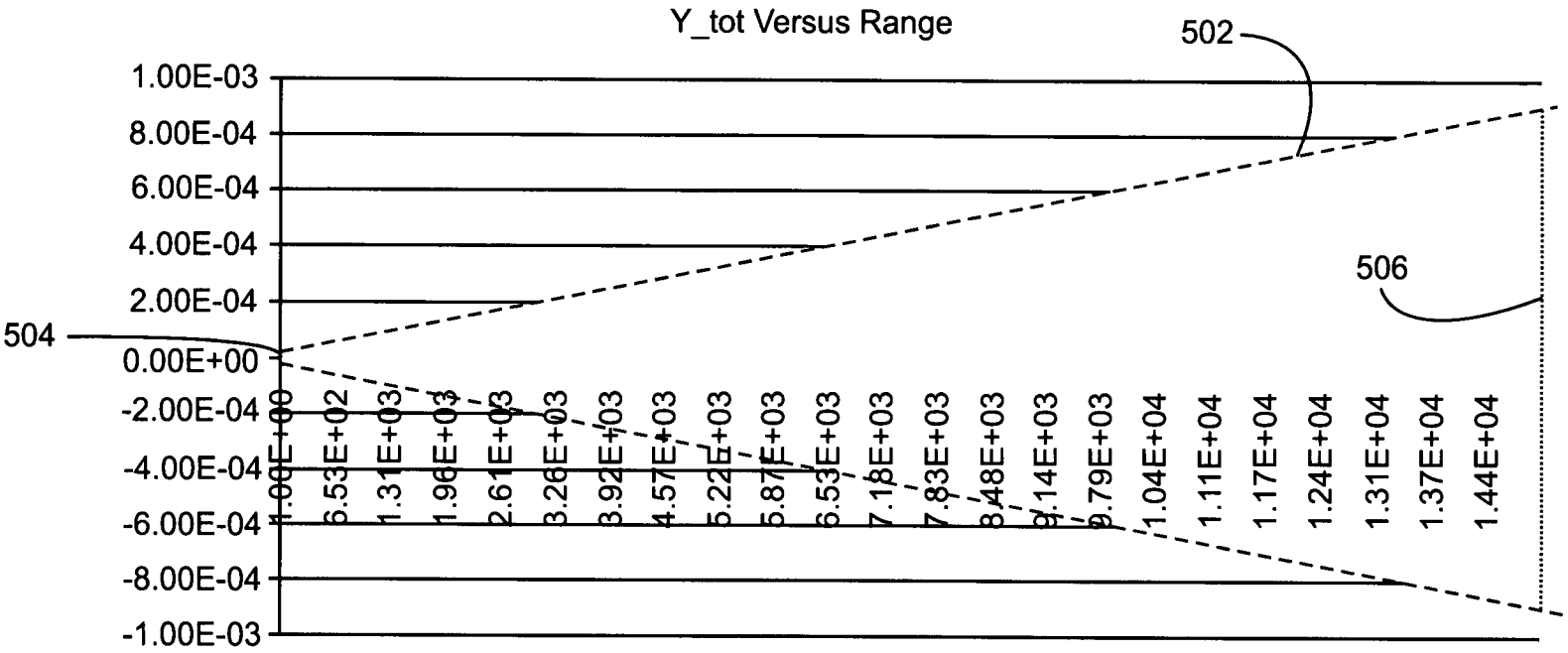
FIG. 4 is a graph illustrating combined signal growth from PEG to target.

Referring now to FIG. 4, the amplitude of the combined signal 502 is illustrated from PEG 504 to target 506. The amplitude grows to a maximum as it approaches the target. The combined wave signal is illustrated as a solid envelop or cone because the individual curves are indistinguishable at the illustrated scale. FIG. 4 also shows that the amplitude of the leading edge grows to about $8.8\times10^{-4}$ upon reaching the target. The amplitude at the target continues to grow, eventually reaching a maximum at 1.79. (neglecting geometric dispersion). This maximum value occurs 5.0×10-5 seconds after the leading edged of the combined wave reaches the target.

The Amplification Potential (AP) equals the ratio of how much energy can be delivered on target using two frequencies (given sufficient input power) versus just one frequency. This is an upper-bound number. Thus: AP=Y_tot_max_at_R/Y_tot_p, where Y_tot_max_at_R is the maximum value of the combined waves at the target range, which is different from the intuitive value of 2.0 because the two waves never reach their maximum values at the same time. For this example, Y_tot_max_at_R=1.79.

Y_tot_p is the combined amplitude at the end of the first Pulse Width, which is 0.0000417 units for this example. Hence: AP=1.79/0.0000417=42,925. The actual intensity level at a target 15 km downrange from the gun would be diminished by a factor of 15,000 squared or 2.25 million. A fully powered PEG system would reduce this attenuation factor from 2.25 million to just 52.4.

Another way of looking at the amplification provided by the PEG system is to calculate how much a PEG system can extend the range of an existing HPRF device. Since the amplification factor, AP, equals 42,925, the range would be extended this same amount, provided the output power of the HPRF device was increased accordingly. Smaller increases in output power would yield corresponding smaller increases in range. The PEG system automatically increases the output power level by a factor of two just by employing two radar beams instead of one. Any remaining increase in output power would have to come from more powerful radars.

System designers can increase the absolute value of energy pumped into the atmosphere by increasing the Pulse Width. However, doing so also decreases the amplification potential, AP.

The wave signals are amplified before they are combined. In one embodiment, the antennas used to generate the two or more waves are enclosed in a vacuum dome that allows the signal waves to be combined prior to entering the atmosphere. Preferably, the antennas are symmetric so that the plurality of signal waves combine uniformly.

In addition to combining the signal waves at the source, two additional implementation issues are precisely generating the multiple frequencies required and switching the signals on and off without generating harmful transients. These issues are addressed by taking advantage of the Doppler shift that occurs when a signal source moves with respect to the receiver. A Doppler shift only changes the frequency of a continuous signal and not its phase.

Figure 5:
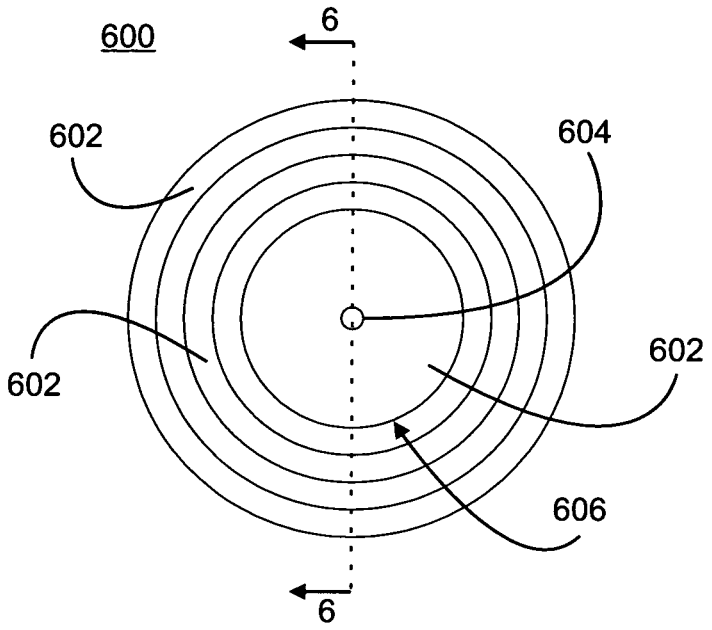
FIG. 5 is a schematic representation of an embodiment of a symmetric antenna for use in the PEG.
Figure 6:
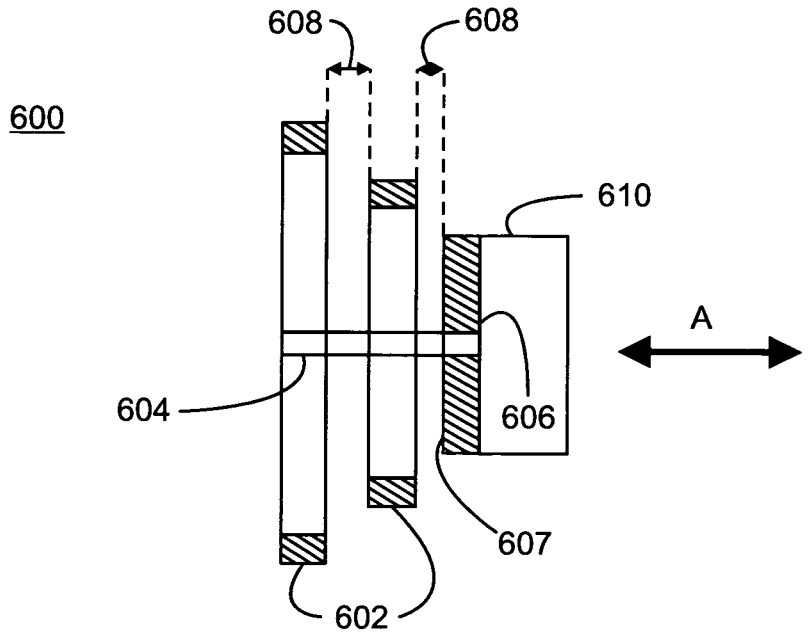
FIG. 6 is a view through line 6-6 of FIG. 5.

Referring to FIG. 5, and embodiment of a symmetric antenna 600 in accordance with the present invention is illustrated. The symmetric antenna includes a plurality of circular antenna plates 602. As illustrated the antenna includes three plates, a central circular antenna 606 and two outer ring-shaped antenna. However, the antenna is not limited to three separate antennas. All antennas are driven by a single signal source and are concentric to a common central axis. Referring to FIG. 6, each set of adjacent antennas are spaced from each other along the common central axis 604 by a given distance 608, i.e. offset axially, by a distance that is one half the wavelength of the first signal that is produced by the central antenna 606, $\Delta_1/2$. The $\Delta_1/2$ offset produces the 180 degree difference in phase between the first signal and each second signal as the waves from those signals exit the PEG.

For the two-frequency example used herein, the $\zeta_1/2$ offset equals about 0.003138 meters (0.124 inches). A single HPRF signal is fed to all of the antennas, with the central antenna mounted on a Doppler Shift Device (DSD) 610 that vibrates the central antenna along the central axis collinear with the line between the antenna and target in the direction of arrow A. Thus the central antenna is termed the "signal source" that moves at some velocity $v_s$. Suitable configurations for the DSD include, but are not limited to, crystal and piezoelectric devices that causes the face 607 of the antenna to execute step-function changes in velocity. With this configuration, in the absence of movement of the central antenna ($v_s$=0), the outputs of the antennas will always cancel one another.

If this offset is changed by a small percent, for example less than 0.01% of $\Delta_1/2$ (or 1/1,000), then the two frequencies will still essentially cancel one another, at all times and distances. However, if a velocity, $v_s$, is imparted on the central plate for an extremely short period of time, $\Delta t$, the two waves emitted during this short period will have different frequencies due to the Doppler shift. Also, their relative phases will remain essentially unchanged (less than 0.01%) because the velocity, $v_s$, is applied for so short of time.

The velocity, $v_s$, needed to create a wavelength $A_2$ from an original wavelength, $\lambda_1$, is determined by their relative magnitudes. If the central antenna moves toward the PEG with a velocity, $v_s$, the wavelength emitted from the central antenna, as viewed by a stationary observer, $\lambda_2$, will be shifted from the wavelength emitted from a stationary plate, $\lambda_1$, according to the relativistic Doppler equation $\lambda_2=\lambda_1(n_1/n_2)(1+v_s n_2/c)/[1-(v_s n_2/c)^2]^{1/2}$, where c is the speed of light, and $v_s$ is positive when moving away from the stationary observer.

Rearranging terms yields the quadratic equation from which $v_s$ can be readily calculated $v_s^2+v_s(2cn_2\lambda_1^2n_1^2)/k+c^2[(\lambda_1 n_1)^2-(n_2\lambda_2)^2]/k$, where $k \equiv n_2^2\ [(\Delta_1 n_1)^2+(n_2\lambda_2)^2]$. Substituting the two wavelengths from the example presented herein yields a $v_s$ of about 62.73 meters/second.

The center antenna can be moved indefinitely if its direction is periodically reversed after some time, $\Delta t$. More specifically, setting $\Delta t$ equal to the time it takes to execute the first pulse width, PW, yields the relation: $\Delta t$=PW/c. Accordingly, for the two-wave example presented in this paper, $\Delta t$ equals (0.20/3E08)=6.66E-10 seconds (66.6 nanoseconds). Periodically reversing the velocity of the center antenna produces a square-wave velocity profile. The maximum displacement of the moving antenna equals $v_s\Delta t$= (62.73 m/sec)×6.66E−10(sec)=4.18E−08 m, which is 0.0013% of $\Delta_1/2$, a size of movement for the central antenna that is about $\lambda_1$/75,021.

Regarding the performance of the PEG in accordance with the present invention, abruptly changing the relative frequencies only affects the packet of pulses emitted during the particular pulse width and not the frequencies contained in prior or subsequent pulse widths. In addition, the movement of the central antenna, which executes a square wave, is not tied to the phase of the high-frequency wave, $\lambda_1$, or the timing of the pulse width—the square wave transitions actually start and stop the pulse widths. A vibrating antenna periodically reverses its direction of travel. Alternating the antenna's direction of travel causes the Doppler-shifted frequencies that the antenna transmits to periodically shift above and below the frequency of the stationary antenna. Hence, reversing the direction of antenna travel causes the signals from the stationary antenna and the vibrating antenna to automatically cancel each other when the vibrating antenna returns to its starting position. The result is that the two continuous waves combine to behave like a pulsed radar and do not need to be switched on and off.

When the central antenna is driven with a square wave, the Doppler-shifted frequency, $f_2$, will alternately be shifted above and below the base frequency $f_1$. However, the combined signal will resemble that of two frequencies that differ from one another by a constant amount. In both cases, the combined signals gradually come into phase as they propagate toward the target.

Generating the second frequency from the first frequency, after the first frequency has been amplified, allows precise replication of the side lobes created by the amplification process. This result is important because if two different frequencies are separately amplified, two different sets of side lobes would be produced, which would not be cancelled by simply shifting the phase of one frequency group by 180 degrees. Thus, generating two identical frequencies from a single, post-amplified frequency is generally preferred.

In one embodiment, the piezoelectric devices are used to move the central antenna at the constant velocity $v_s$ by driving them with a "saw tooth" voltage profile shown. An exemplary response time for piezoelectric devices is 10 μsec for a 0.05% strain. However, this small delay only affects startup time since after startup the applied voltage is continuous.

Since the strain in piezoelectric devices, $\epsilon$, is proportional to the piezoelectric constant, d, times the electric field strength, E, the displacement, u, at the end of a piezoelectric device is given by $u=L\epsilon=LEd$, where L is the equivalent length of the piezoelectric device. The change in displacement with time is desired to equal $v_s$, or $u=v_s t$. Hence, $E=v_s t/Ld$ During the return cycle, the equation for the electric field is given by $E=E_1-v_s t/Ld$, where $E_1=v_s PW/Ld$ (with the pulse width PW measured in seconds). The above equations are adjusted to compensate for any non-linearity in the piezoelectric constant, d, with electric field strength. The best choice for the actuator is a Piezostrictor material such as BST (barium stannate titanate) $[Ba(Sn,Ti))_3]$, because of its long linear range at high fields. Further, BST is lead free and is therefore more environmentally friendly. BST devices achieve strains of approximately 5.5E-4 at a field strengths of 20 kV/cm, corresponding to a d of 2.75E-8 (5.5E-4/20E3=2.75E-8). Substituting this value into the piezoelectric displacement equation yields the required length of the device for our system. For a 10 volt electric field, the required length, L, is given by $$L = \frac{u}{Ed} = 4.18E - \frac{08}{10 \times 2.75E - 8} = 0.152 \text{ meters (5.98 inches).}$$

A two-frequency or multi-frequency PEG of the present invention increases the range of a single-frequency high power radio frequency (HPRF) device from about 1 km to about 15 km by keeping the intensity below the one megawatt/square centimeter air ionization level. This suppression of intensity near the mouth of the gun allows more powerful radars to be employed, thereby extending range. A multi-frequency system having a base wavelength of 6.275 millimeters (47.79 GHz) has the potential of increasing the energy delivered on target by a factor of 21,485, provided that radars can be developed capable of generating the required signal intensities.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments, which would come within the spirit and scope of the present invention.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A method for projecting energy from a source to a target, comprising:

generating at least two signals from the source simultaneously, wherein said at least two signals comprise a first signal, which comprises a first frequency and a first wavelength, and at least one second signal comprising a second frequency and a second wavelength, and wherein the first and second wavelengths comprise a different propagation speed through a given medium and the first and second frequencies are selected to move a combined amplitude of the first and second signals from a minimum amplitude to a maximum amplitude over a given distance based on propagation speeds of the first and second wavelengths;

adjusting a relative phase difference among the at least two signals for generating the minimum amplitude of the combined amplitude at the source; and transmitting the at least two signals from the source through the given medium to a target being located at the given distance from the source.

2. The method of claim 1, wherein said generating said at least two signals further comprises generating a plurality of signals, which comprise the first signal and a plurality of second signals, each second signal comprises a distinct second frequency and a distinct second wavelength, each distinct second wavelength comprises a different propagation speed through the medium, the first frequency and the plurality of distinct second frequencies selected to move a combined amplitude of the first and second signals from a minimum amplitude to a maximum amplitude over a given distance based on propagation speeds of the first wavelength and the plurality of distinct second wavelengths.

3. The method of claim 1, wherein the source comprises a plurality of waveform generators, one waveform generator for each generated signal.

4. The method of claim 1, wherein the method further comprises amplifying each signal prior to transmitting each signal through the given medium.

5. The method of claim 1, wherein said at least two signals comprise an acoustic signal, an electromagnetic signal, a sonar signal or a radar signal.

6. The method of claim 1, wherein transmitting said at least two signals further comprises transmitting a series of distinct pulses, each pulse comprising the at least two signals and an equal number of wavelengths of the first signal.

7. The method of claim 1, wherein transmitting said at least two signals further comprises transmitting the first signal and the second signal at a phase difference of about 180 degrees.

8. The method of claim 1, wherein transmitting said at least two signals further comprises using a plurality of antennas to transmit the at least two signals, and wherein a separate antenna is used to transmit each signal.

9. The method of claim 8, wherein said plurality of antennas comprises a plurality of circular, concentric antennas with a common axis, the common axis directed at the target.

10. The method of claim 9, wherein the plurality of antennas comprise a central antenna, said transmitting said at least signals further comprises uses the central antenna to transmit the first signal.

11. The method of claim 9, wherein the plurality of antennas comprise a central antenna, said transmitting said at least two signals further comprises using the central antenna to transmit the first signal, and wherein said transmitting said at least two signals further comprises moving the central antenna in a reciprocal motion along the central axis relative to the other antennas to induce a Doppler shift between the first signal and the second signal.

12. The method of claim 8, wherein the plurality of antennas are spaced along the common axis such that a spacing distance between any two adjacent antennas along the common axis equal one half the first wavelength.

* * * * *